United States Patent [19]

Portalier

[11] 3,960,201

[45] June 1, 1976

[54] INJECTION DEVICE FOR MOLDING MACHINES

[75] Inventor: Robert Portalier, Ville d'Avray, France

[73] Assignee: Societe de Vente de l'Aluminium Pechiney, Paris, France

[22] Filed: Dec. 13, 1974

[21] Appl. No.: 532,641

[52] U.S. Cl. ..... 164/312; 164/321; 164/120

[51] Int. Cl.[2] ..... B22D 17/30

[58] Field of Search ..... 164/119, 284, 312, 313, 164/314, 316–319, 321, 113, 120, 315

[56] References Cited

UNITED STATES PATENTS

| | | | |
|---|---|---|---|
| 3,344,834 | 10/1967 | Hall et al. | 164/312 |
| 3,437,130 | 4/1969 | Johnson et al. | 164/120 X |

FOREIGN PATENTS OR APPLICATIONS

| | | | |
|---|---|---|---|
| 2,248,896 | 5/1975 | France | 164/312 |

*Primary Examiner*—Francis S. Husar
*Assistant Examiner*—Carl Rowold
*Attorney, Agent, or Firm*—Dennison, Dennison, Meserole & Pollack

[57] ABSTRACT

The invention concerns an improved injection device for molding machines with a cooling chamber for casting of non-ferrous metals and alloys. It is characterized by a two-part piston, one part of which slides freely and coaxially inside the other, forming a chamber in which a gas, neutral with respect to the metal to be cast, is compressed by the forward movement of the piston by virtue of a stop-pin, then liberated and expanded at the end of injection in a container of liquid metal where it causes a balancing force effect and improves the filling of the mold.

This device makes it possible to eliminate the "ramroddings" which occur in single-piston machines at the end of injection and to obtain cast products which are free of defects.

4 Claims, 6 Drawing Figures

INJECTION DEVICE FOR MOLDING MACHINES

The present invention concerns an improvement of the injection piston of pressurized molding machines having a cooling chamber, and especially machines for the casting, under pressure, of non-ferrous metals and alloys such as aluminum, zinc, copper, magnesium and the like.

In these machines, the filling of the mold is obtained by injection of a liquid metal in a mold from a container whence the liquid metal is propelled by a piston under pressure which is generally on the order of several hundreds of bars. The filling of the mold is always very rapid and the end of the injection is accompanied by two extraneous phenomena:

1. A "ramrod" effect by the abrupt halt of the piston and the entire apparatus which is of one piece with it, by reason of the incompressibility of the liquid metal. This phenomenon implies, for the mold-closing device, the use of a device having a force distinctly higher than the calculated injection pressure, and moreover, is often accompanied by vibrations of the piston;

2. The thrust of the piston occurs uniformly over the flat part of the tablet formed in the container ahead of the piston head; as soon as the peripheral part of the tablet solidifies or becomes sufficiently pasty, the resistance to the advance of the piston becomes such that the latter stops while the central part of the tablet is still liquid. The cooling continues, and the central portion contracts and excludes the possibility of a balancing force, i.e., compensation for the shrinkage of the cast piece by the liquid metal remaining available.

Various solutions have been suggested to eliminate these disadvantages, especially, a system with a double concentric piston, in which a small auxiliary piston, arranged in the axis of the main piston, is actuated at the end of injection so as to exert its thrust on the zone of the tablet which is still liquid or pasty. This device was the object of French Pat. No. 1,397,882, in the name of General Motors, and the process is known in the art under the trademark ACURAD. However, this solution complicates tremendously the hydraulic control system, necessitates perfect synchronization of the movement of the two pistons, and causes a double "ramrod", which subjects the machine to a severe test of strength.

The applicant has discovered and developed an improvement of the liquid metal injection device which eliminates both of the aforementioned disadvantages, and which does not necessitate a double system of hydraulic control.

The present invention concerns an improved injection device, for casting machines under pressure and with a cooling chamber, for non-ferrous metals and alloys, characterized by the fact that it includes an injection piston which receives the compression force of the casting machine, but does not enter into contact with the metal flowing freely and coaxially inside a pushing piston which transmits the force of compression to the metal to be cast in a container, thus forming a chamber in which a gas, which is neutral in relation to the metal to be cast, previously introduced under an initial pressure of 50 to 500 bars and preferably from 100 to 150 bars, is found, due to a coaxial stop pin, strongly compressed toward the end of the injection between the push piston, immobilized by the metal which begins to solidify on the walls of the container, and the injection piston which continues to advance, then, by the advance of the stop pin, disengaged by the injection piston at the end of travel, is liberated and expanded in the container where it causes an extremely effective balancing force effect on a core portion of the injected metal which is still liquid and ensures perfect filling of the mold.

This device offers a considerable improvement over the prior art. It makes it possible, especially:

a. to use injection machines to the maximum of their theoretical power, owing to the elimination of the "ramroddings";
b. to obtain better compactness of the molds, and to eliminate all piling within the piece;
c. to decrease the mechanical wear of the molds, thus increase their life;
d. to decrease the tendency to form burrs on the joints of the molds; and
e. to decrease the wear on the head of the push piston through the effect of a gas cushion and thermal screen between the pastille and the piston.

The figures which follow, given as illustrations and as non-limiting examples, will allow better understanding of the structure and operation of the device which is the object of the present invention.

Figure 1:
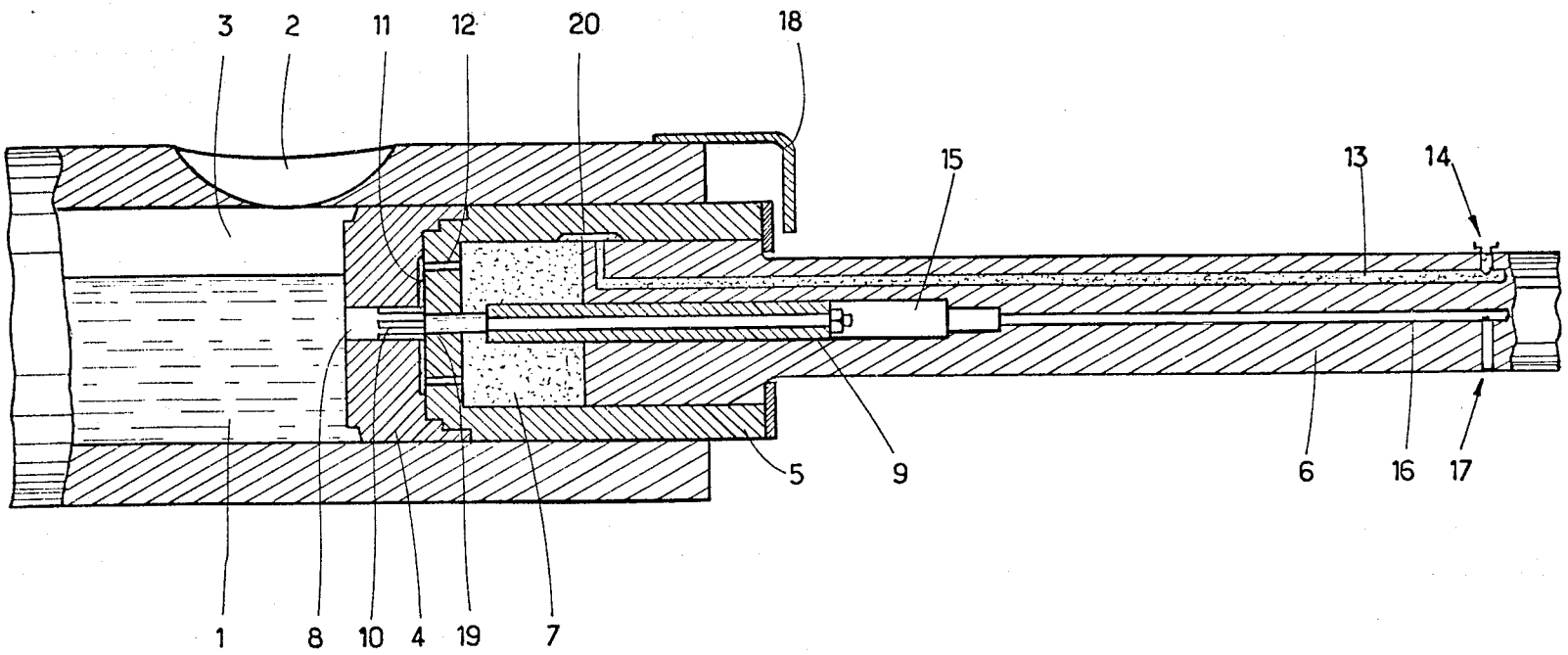
FIG. 1 is a sectional elevation of the improved injection device in accordance with the invention.

In FIG. 1, the mold, not shown, is to the left of the figure; the injection device being in its initial position. A container 3, connected to the mold, and equipped with a filling orifice 2 is used to receive the liquid metal 1. The injection device comprises a heat 4 of one piece (but which can be dismantled and exchanged when worn out) with the press piston 5 in which slides the injection piston 6 forming a chamber 7, the volume of which is variable depending on the relative position of the injection piston 6 and the press piston 5. The head 4, the injection piston 6 and the press piston 5 have an axial cylindrical orifice in which a pin 8 can slide, guided by the pin guide 9. The pin head 8 has longitudinal grooves 10 over about one half its length which communicate by grooves 11 placed opposite and by openings 12, with the chamber 7. The chamber 7 is also linked by the groove 20 and canal 13 with an opening 14 through which a pressurized gas can be introduced. Behind the pin-guide 9, a chamber 15 communicates, by the canal 16 with an opening 17 which is open to the air.

It is appropriate to refer to as "forward" any movement of the mobile parts toward the left of the figures, and "reverse", any movement of the mobile parts toward the right of the figure.

The system operates in the following manner:

With the mold closed, the liquid metal or alloy 1 is introduced through the opening 2 in the container 3, either manually or by a feed system of known type, in a quantity such that the level of the liquid clearly exceeds the axis of the piston and, that at the end of the mold-filling operation, the tablet constituted by the excess of the metal or alloy is thick enough to fulfill its function as a balancing force by remaining liquid a little longer than the cast piece. Through opening 14, nitrogen, preferably, or any other inert gas with respect to the liquid metal, is applied under high pressure, on the order of 100 bars. Through the canal 13 and the groove 20, this pressure of nitrogen is exerted in the chamber 7 and has the effect of causing the injection piston 6 to reverse until it stops against the ring 18. In like manner, the pin 8 and guide 9 are pushed back and reverse until the shoulder 19 comes to rest on the front side of the press piston 5. Since the grooves of the pin head are shorter than the thickness of the piston head 4, imperviousness is ensured, and the gas under pressure cannot reach the liquid metal 1.

Figure 2:
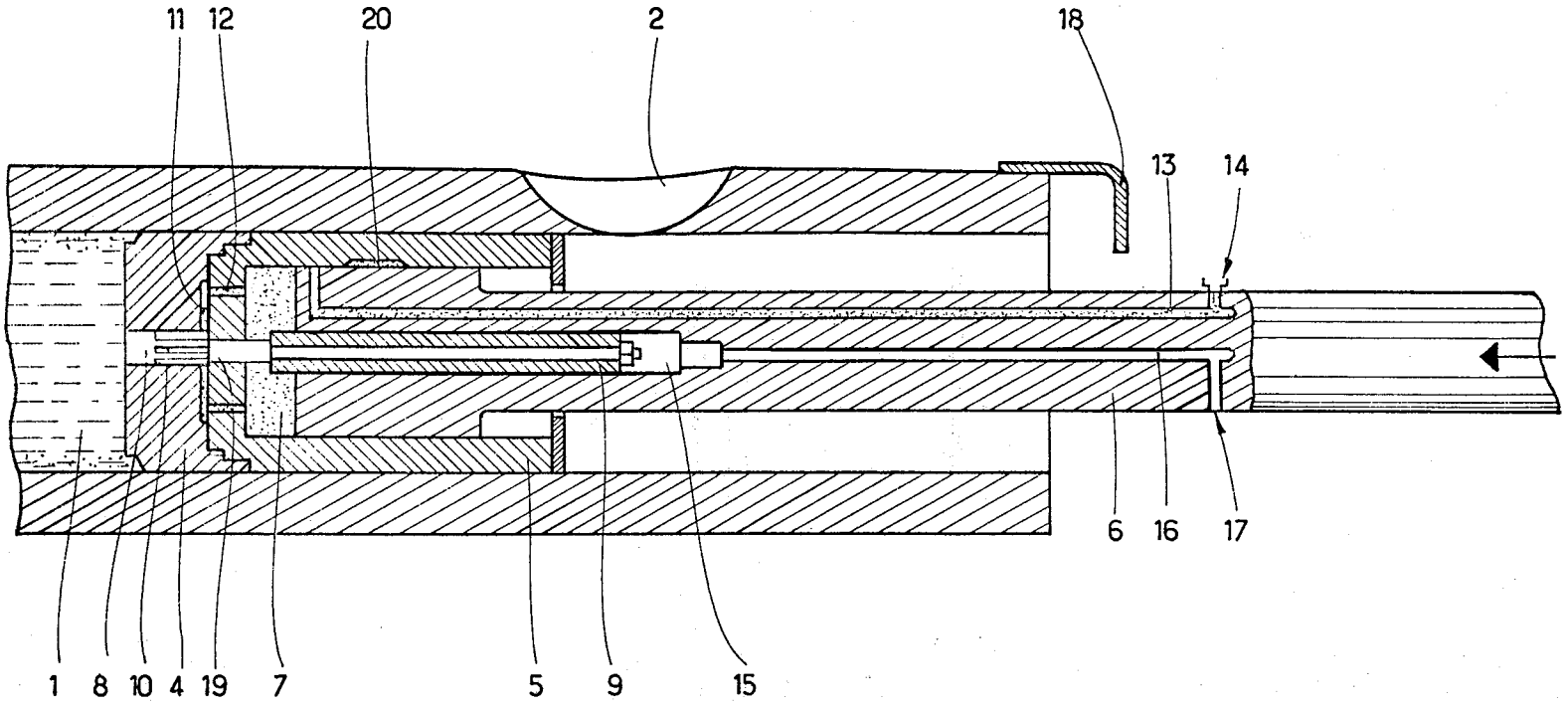
FIGS. 2 to 6 are similar to FIG. 1, and represent the successive positions of the main injection piston and the coaxial pin for a complete injection cycle.

FIG. 2 represents the second phase of the injection process: the injection piston 6, under the action of the injection pressure, applied by means of any hydraulic, pneumatic or mechanical device known in and of itself, but not shown in the figure, has advanced into the injection chamber 3, and has gone by the filling opening 2 and has pushed the liquid metal 1 into the mold. The excess metal begins to solidify on the cool walls of the chamber, which blocks the advance of the head 4 and of the press piston 5. On the other hand, owing to the compressibility of the gas in the chamber 7 and the fact that the pressure exerted on the injection piston 6 is several times higher than that being exerted initially in the chamber 7, the injection piston continues its forward movement, reducing the volume of the chamber 7, where the pressure increases. This compression of the chamber 7 serves as a shock absorber and greatly attenuates the "ramrod" in the control system of the injection piston 6. The injection piston 6 has passed by groove 20, thus ensuring the imperviousness of the chamber 7.

Figure 3:
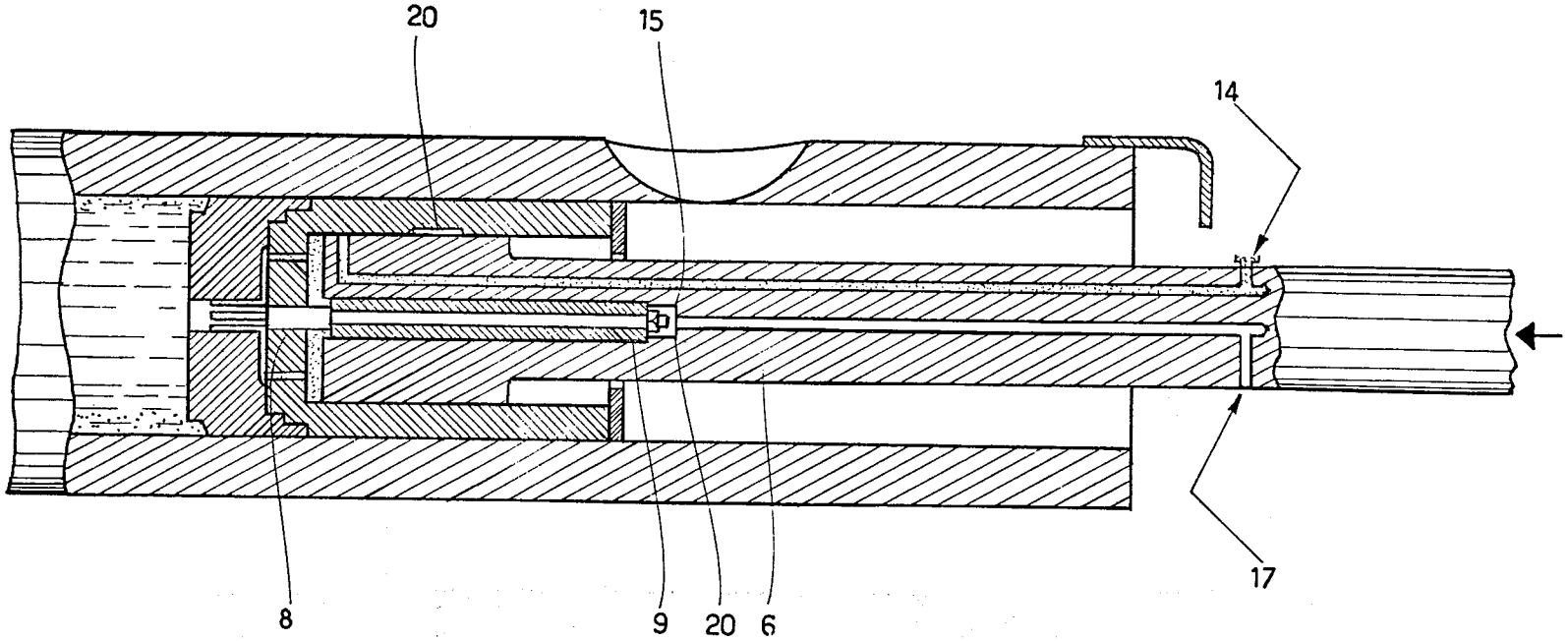

FIG. 3 represents the 3rd phase in the injection process. The pressure on the injection piston 6 continues to increase, with the tail of the pin-guide stopping on the bottom 20 of the axial cylindrical opening arranged in the piston 6.

Figure 4:
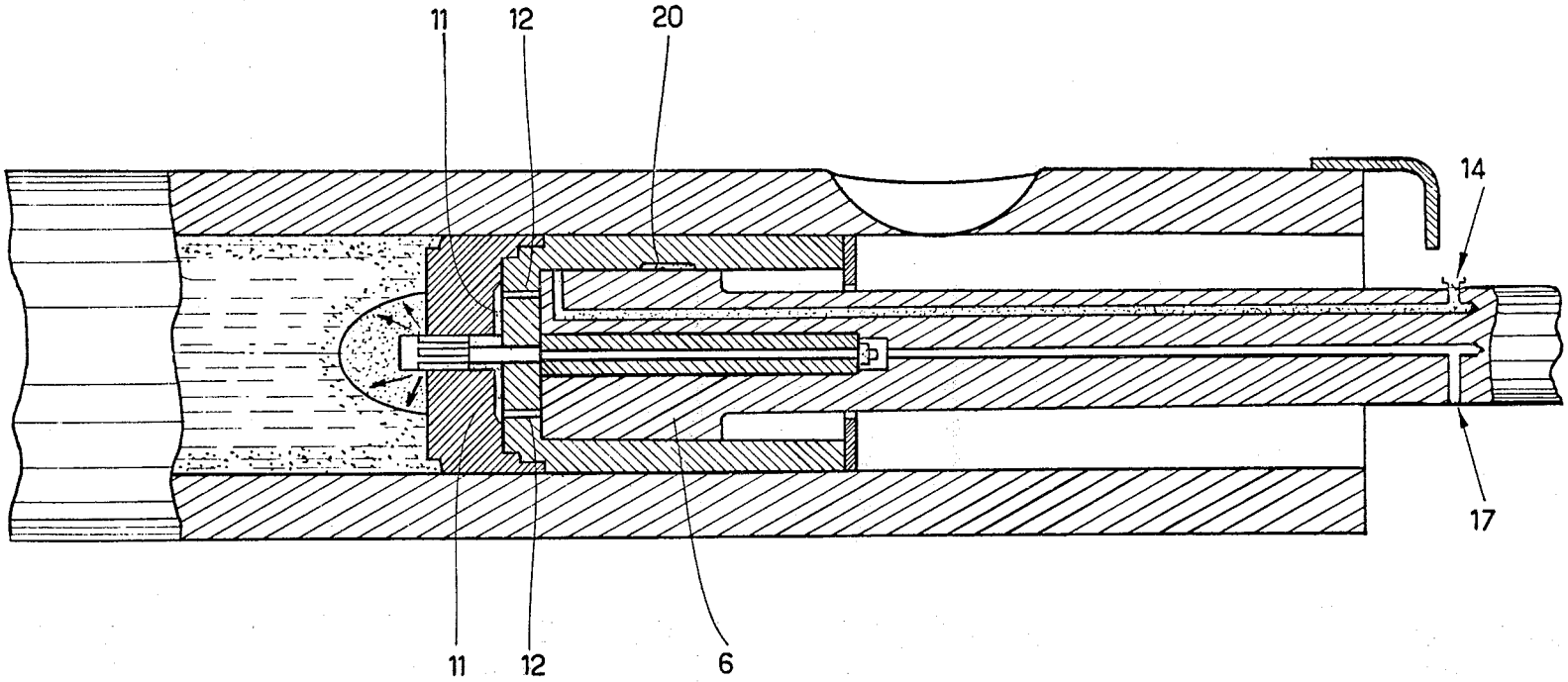

FIG. 4 represents the third phase of the injection process. The pressure on the injection piston 6 continues to increase, pushing the pin 8 forward, and its head penetrates the central part of the tablet, which is still liquid, until such time as the grooved part of said head opens, allowing the highly compressed gas in the chamber 7, under a pressure of several hundreds of bars, to expand, causing the balancing force action, all the more effectively since the elevated temperature of the tablet increases the pressure of the gas still more. The balancing force effect occurs, then, by means of an intermediate "gaseous piston" which perfectly assumes the shape of the entire irregular excess.

Figure 5:
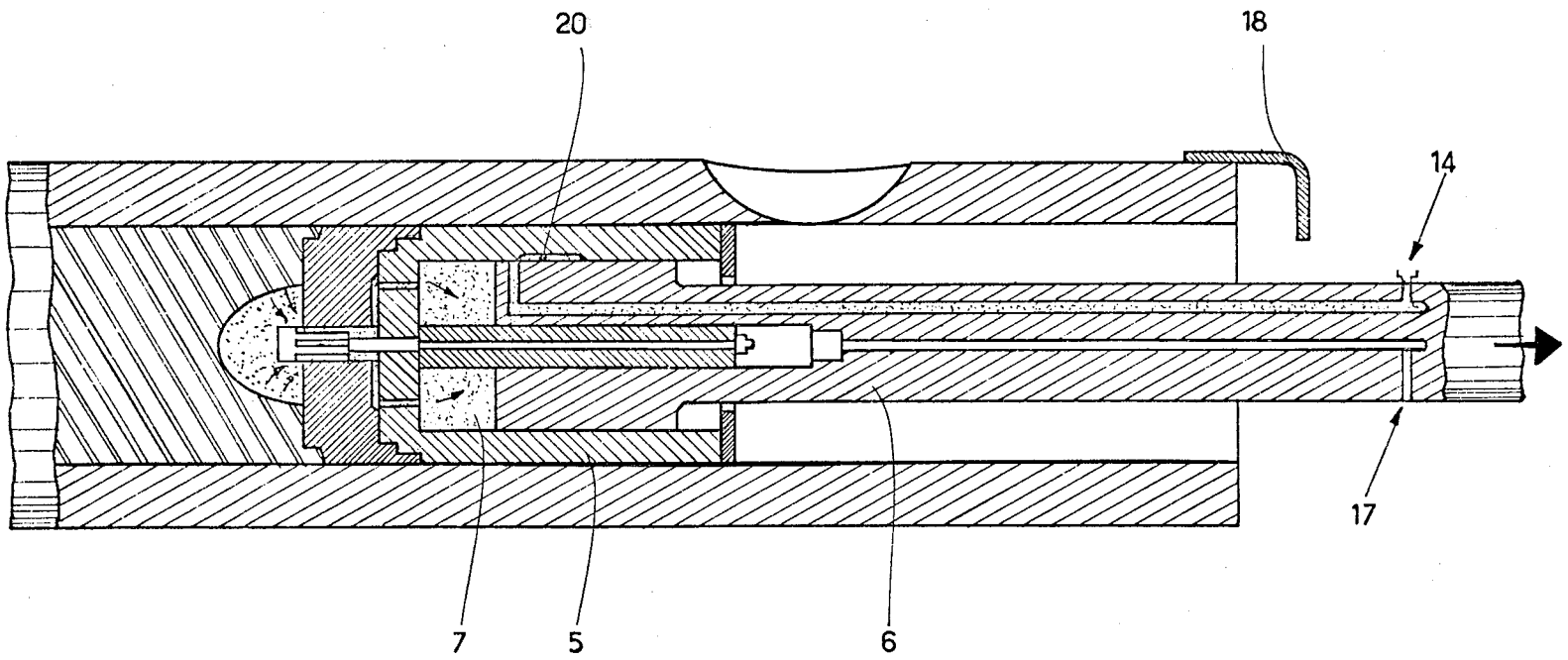

FIG. 5 represents the 5th phase in the injection process the tablet is solidified. The excess is localized on the zone in contact with the pin-head, thus with no harmful effect on the piece cast; the tablet is subsequently cut off and remelted.

Figure 6:
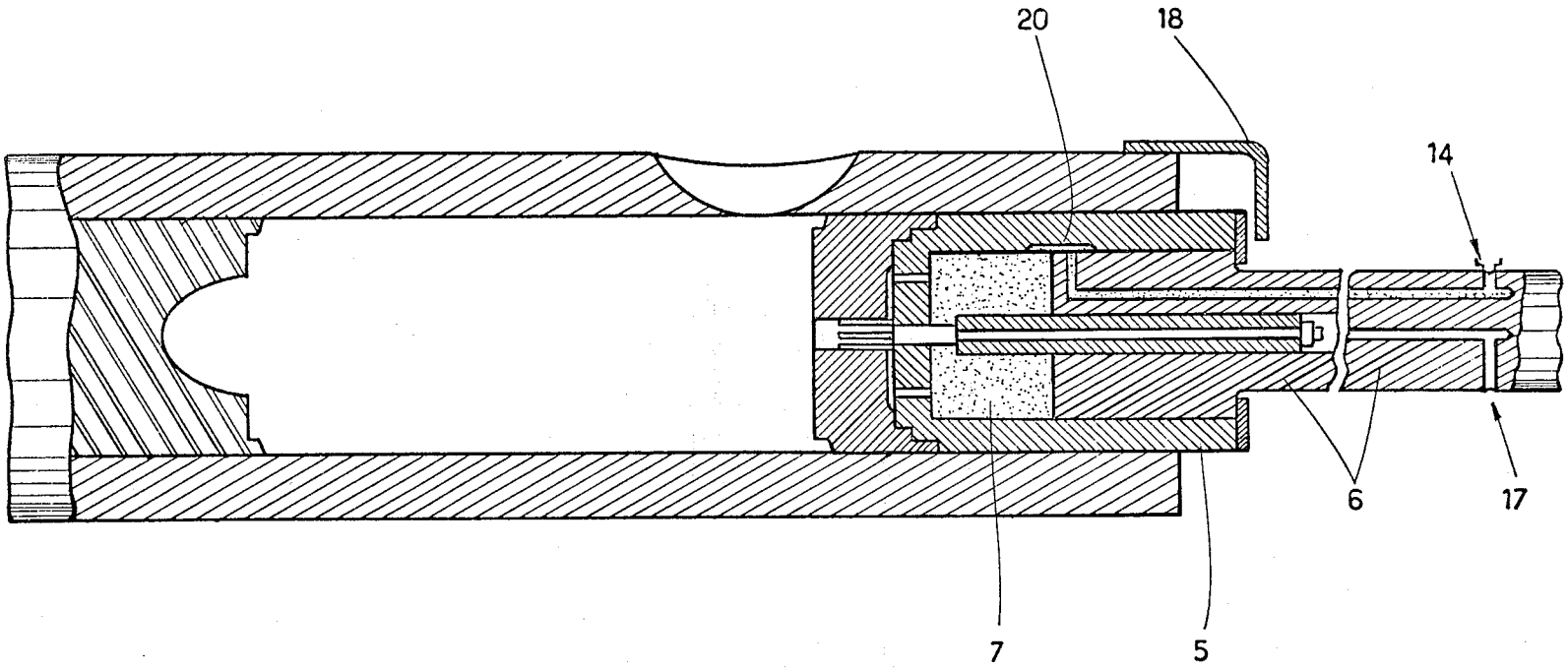

FIG. 6 represents the 6th or final phase in the injection process, which is the return of the system to its initial state. The injection piston 6 is brought back by the control device of the machine. Theoretically, the compression piston 5 and the pin 8 should return automatically to the initial position. However, if there is no more residual pressure in the chamber 7, the return of the pin 8 to the "shut" position might not occur. Thanks to the block stop 18, the compression piston 5 stops shortly before the end of the rear stroke of the injection piston 6. This puts the chamber 7 into communication by the canal 13 and the groove 20, and the opening 14 with the source of inert gas which is at a pressure of some 100 bars. The effect of the increase of pressure in the chamber 7 is to separate the injection piston 6 and the compression piston 5, and to cause the pin-guide 9 to move back toward the right. The exposure of the chamber to the open air 15 by the canal 16 and the opening 17 avoids any cushion of air hindering the movement of the pin.

The system is then in place for the next injection cycle.

The device according to the invention makes it possible, moreover, to maintain all the other features of pressurized casting machines with a cooling chamber and especially does not decrease the rhythm of production for which it was planned.

I claim:

1. An improved injection device for pressurized machines having a cooling chamber for casting nonferrous metals and alloys adapted to cause an effective counter effect on the still liquid metal comprising, an injection piston (6) to receive the compression effort of the casting machine but remaining out of contact with the metal, a compressing piston (5) to transmit the compression force to the metal to be cast, said injection piston sliding freely and coaxially within the compressing piston, a container (3) to receive the metal to be cast, a variable volume chamber (7) within the compressing piston, said chamber having one wall face defined by the end of the injection piston adapted to receive a gas which is inert with respect to the metal to be cast, an orifice in said compressing piston allowing communication between said chamber and said container, and a stop pin coaxial with said injection piston and received within said orifice to normally block gas flow through said orifice.

2. An injection device as set forth in claim 1, wherein the inert gas is trapped in said chamber and is highly compressed between the compressing piston and the injection piston near the end of liquid metal injection into said container, said compressing piston being immobilized by the metal which begins to solidify on the walls of the container, the advance of said injection piston causing the stop pin to move further within said orifice, means on said stop pin to liberate the gas in said chamber to permit flow through said orifice into said container at a predetermined point of stop pin travel to cause a balancing force effect.

3. An injection device as set forth in claim 2, wherein the inert gas is introduced into said chamber under an initial pressure within the range of 50 to 500 bars.

4. An injection device as set forth in claim 2, wherein the inert gas is introduced into said chamber under an initial pressure of from 100 to 150 bars.

* * * * *